US005559398A

United States Patent [19]

Asakura et al.

[11] Patent Number: 5,559,398

[45] Date of Patent: Sep. 24, 1996

[54] CATHODE RAY TUBE AND METHOD OF MAKING THE SAME

[75] Inventors: Syunichi Asakura; Hiroyuki Minagawa, both of Mobara; Koji Sugimoto, Sakura, all of Japan

[73] Assignee: Hitachi, Ltd., Tokyo, Japan

[21] Appl. No.: 461,518

[22] Filed: Jun. 5, 1995

Related U.S. Application Data

[63] Continuation of Ser. No. 982,975, Nov. 30, 1992, abandoned.

[30] Foreign Application Priority Data

Nov. 28, 1991 [JP] Japan ..... 3-338016

[51] Int. Cl.[6] ..... H01J 31/00

[52] U.S. Cl. ..... 313/477 R

[58] Field of Search ..... 313/477 R; 235/488, 235/490, 375; 428/429, 331

[56] References Cited

U.S. PATENT DOCUMENTS

| | | | |
|---|---|---|---|
| 4,327,283 | 4/1982 | Heyman et al. | 235/487 |
| 4,377,890 | 3/1983 | Miller | 313/477 R |
| 4,515,867 | 5/1985 | Bleacher et al. | 313/477 R |
| 4,772,512 | 9/1988 | Nagafuchi | 428/331 |
| 4,775,786 | 10/1988 | Yamano et al. | 235/490 |
| 4,833,306 | 5/1989 | Milbrett | 235/375 |
| 4,856,670 | 8/1989 | Hang et al. . | |
| 5,071,695 | 12/1991 | Tannenbaum | 428/429 |
| 5,098,747 | 3/1992 | Kalchauer | 428/429 |
| 5,214,350 | 5/1993 | Remec et al. | 313/477 R |
| 5,273,798 | 12/1993 | Miner . | |

FOREIGN PATENT DOCUMENTS

| | | | |
|---|---|---|---|
| 0157779 | 9/1984 | Japan | 235/488 |
| 0082433 | 3/1990 | Japan | 313/477 R |

OTHER PUBLICATIONS

Patent Abstracts of Japan, vol. 9, No. 220 (E–341) 6 Sep. 1985 & JP–A–60 081 744 (Nippon Denki K.K.) 9 May 1985.

*Primary Examiner*—Sandra L. O'Shea
*Assistant Examiner*—Vip Patel
*Attorney, Agent, or Firm*—Antonelli, Terry, Stout & Kraus

[57] ABSTRACT

A cathode ray tube having an optically machine-readable coded marking comprising an undercoating layer of heat- and acid-resistant paint, a mark printed with heat-resistant ink on the undercoating layer and an overcoating layer of transparent heat- and acid-resistant paint covering the mark.

8 Claims, 4 Drawing Sheets

CATHODE RAY TUBE AND METHOD OF MAKING THE SAME

This application is a continuation of Ser. No. 982,975, filed Nov. 30, 1992.

BACKGROUND OF THE INVENTION

The present invention relates generally to a cathode ray tube having an optically machine-readable coded marking on an external surface thereof and methods of producing CRTs (Cathode-Ray Tubes) having an, optically machine-readable coded marking, and more particularly to a CRT having a machine-readable marking on an optically machine-readable marking on a sidewall of its glass panel that is prevented from deteriorating during the process of manufacturing the CRT and a method of making the same.

The process of manufacturing CRTs generally fabricates those having different tube types sequentially or selectively using a common CRT assembly line. While CRTs of one type are being manufactured on the assembly line, one component part for use in that type is combined with others for use therein successively.

The common practice that has heretofore been followed is for assemblers to select proper parts to be assembled into CRTs by visually checking the markings attached to the respective parts or checking the parts themselves during the process of manufacturing CRTs. However, assemblers have experienced great difficulty keeping up with not only the work of selecting and conveying corresponding parts but also working meticulously as the size and resolving power of CRTs to be manufactured increase. For this reason, efforts are being made to automate the machining and assembling of parts the whole CRT production line including every step of assembly.

In order to implement the aforementioned automatic machining and assembly, assembly work should be carried out by distinguishing the type of CRTs being presently manufactured and properly selecting parts usable for CRTs of that type in addition to performing machining operations fit for them. In this sense, it has been arranged to attach a marking indicating a type of CRT to be manufactured on the sidewall of its glass panel during the manufacturing process.

In reference to the CRT having a machine-readable marking, particularly a bar code, on the sidewall of its glass panel, Japanese Utility Model Laid-Open No. 136465/1985, U.S. Pat. Nos. 4,374,451; 4,377,890 and 4,515,867, for instance, disclose CRTs of this sort. Of these CRTs, the one disclosed in Japanese Utility Model No. 136465/1985 (hereinafter called the former means) has a bar code printed on the sidewall of its glass panel using a heat-resistant material, the bar code having a number different from what is allocated to another code or a number to be incremented per code. Moreover, those disclosed in U.S. Pat. Nos. 4,374,451; 4,377,890 and 4,515,867 (hereinafter called the latter means) are similar to one another in that a double layer is formed on the sidewall of a glass panel by using two kinds of water glass coatings which differ in composition at the initial stage of the process of manufacturing a CRT before a bar code is formed by irradiating the layer with a laser beam in order to use the bar code for controlling the process of manufacture under computer control by machine-reading the bar code during the process thereof.

Since such a bar code is mainly used to record the state of a CRT being manufactured under control, it is formed on the sidewall of its glass panel at the initial stage of the process of manufacture. During the aforementioned process of manufacture, however, as the glass panel is treated by heating as well as with various kinds of acids after the bar code is formed, the bar code tends to deteriorate and may occasionally wear away.

For the reason stated above, a heat-resistant material has been used to form the bar code by printing, as in the case of the former means, or a laser beam has been used to print the bar code as in the latter means.

Notwithstanding, the former means still poses a problem unavoidably arising from the disappearance of the bar code thus formed, if worst, comes to the worst because the bar code formed on the glass panel deteriorates during the process of manufacturing the CRT.

On the other hand, though the latter means can at least prevent the bar code formed on the glass panel from deteriorating or wearing away during the process of manufacturing the CRT, the use of a laser beam for the formation of such a bar code not only renders the process of manufacture complicated but also makes the manufacturing system costly. The problem is that a unit cost of CRT tends to increase.

SUMMARY OF THE INVENTION

An object of the present invention is to provide a cathode ray tube having an optically machine-readable coded marking on an external surface thereof that is prevented from deteriorating or wearing away during the subsequent process of manufacturing the CRT and a method of making the same.

Another object of the present invention is to provide an apparatus for producing a CRT having such a marking that is prevented from deteriorating or wearing away, at relatively low cost.

In order to accomplish the primary object above, the present invention is a cathode ray tube having an optically machine-readable coded marking comprising an undercoating of heat- and acid-resistant paint, a marking layer on the undercoating, the marking layer being printed with heat-resistant ink, and a transparent heat- and acid-resistant overcoating covering the marking layer, or otherwise a machine-readable marking having no overcoating.

In order to accomplish the primary object above, the present invention is a method of making a CRT comprising undercoating heat- and acid-resistant paint, subsequently printing a machine-readable mark on the undercoating by means of an ink jet printer and heat-resistant ink and finally applying onto the aforementioned mark an overcoating of transparent heat- and acid-resistant paint, or with the omission of the aforementioned overcoating.

In order to accomplish the secondary object stated above, the present invention is a system comprising a CRT glass panel carrier line and a CRT shadow mask carrier line which are arranged in parallel, means provided on the respective carrier lines for identifying the sizes and types of the glass panel and the shadow mask thus conveyed, means for transferring the shadow mask on the shadow mask carrier line to the glass panel carrier line in order to assemble the shadow mask into the glass panel intended for the shadow mask, means for forming an undercoating layer on the sidewall of the glass panel incorporating the shadow mask, means for forming an optically machine-readable coded marking on the undercoating layer, means for forming a transparent overcoating layer on the mark if needed, and means for forming a fluorescent screen on the downstream side of the means for forming the overcoating layer on the glass panel carrier line.

The present inventors investigated the causes for deterioration or disappearance of the bar code formed by printing with the heat- and acid-resistant material (ink) on the sidewall of the glass panel of the CRT during the subsequent process of its manufacture by repeatedly carrying out experiments, which resulted in finding out that the ink that had firmly stuck to the surface of the glass panel was erased therefrom, not because the ink dissolved when the marking with the bar code came in contact with acid, particularly fluoric acid, but because the fluoric acid that had reached the surface of the glass panel below the marking through the extremely thin ink layer dissolved the very surface thereof.

Therefore, the undercoating layer of heat- and acid-resistant paint which is highly resistant to fluoric acid is formed first and then the machine-readable marking is printed on the undercoating layer with heat-resistant ink by means of an ink jet printer apparatus and further the transparent overcoating layer of heat- and acid-resistant paint is formed thereon as occasion demands according to the present invention.

The optically machine-readable coded marking thus formed and subjected to acid resistance tests, particularly to fluoric acid resistance tests, proved excellent in that the machine-readable marking having the threefold layer comprising the undercoating layer, the mark and the overcoating layer was almost free from deterioration. With respect to the machine-readable marking having the double layer comprising the undercoating layer and the mark, it was not deteriorated much and seen to fully remain in the range of practical use. The reason that the mark is free from suffering further deterioration is attributable to the fact that fluoric acid is prevented by the aforementioned overcoating and undercoating layers, particularly by the undercoating layer, from reaching the surface of the glass panel below the marking, whereby the ink is not peeled off the surface of the glass panel because the surface thereof is not dissolved by the acid.

According to the present invention, the machine-readable marking formed during the process of manufacturing the CRT is thus prevented from deteriorating and disappearing, without the failure to read the aforementioned marking or misreading of such a marking in the subsequent process of manufacture. The marking thus formed becomes usable effectively at various places.

Even when the means for applying the undercoating layer for use in providing the aforementioned marking is supplemented during the process of manufacturing CRTs, or the means both for applying the undercoating and overcoating layers are supplemented likewise during that time, very simple means are only sufficient for the purpose and consequently they will never make a CRT manufacturing apparatus complicated in construction nor make it costly. As a result, a unit price of CRT is not raised.

DESCRIPTION OF THE PREFERRED EMBODIMENTS

Referring to the accompanying drawings, an embodiment of the present invention will subsequently be described.

Figure 1:
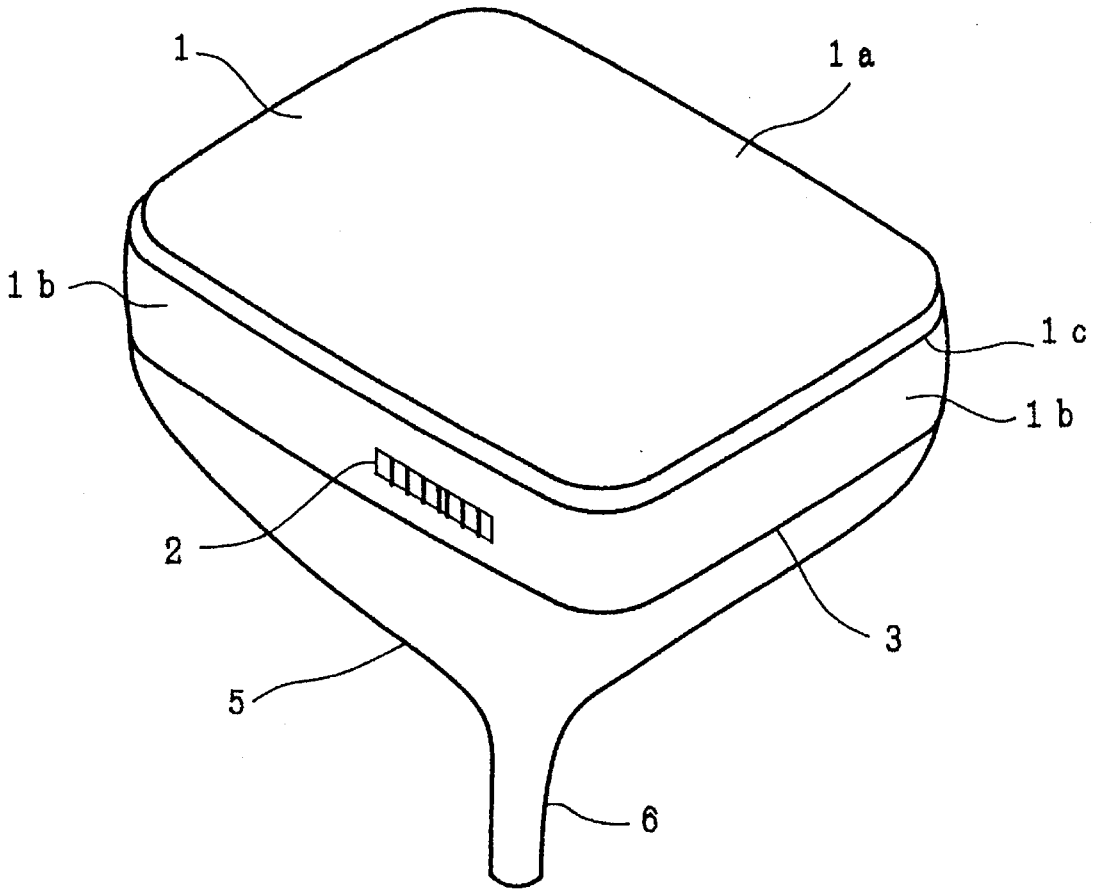
FIG. 1 is a perspective view of a CRT embodying the present invention, the CRT being provided with an optically machine-readable coded marking on the sidewall of its glass panel.
Figure 2:
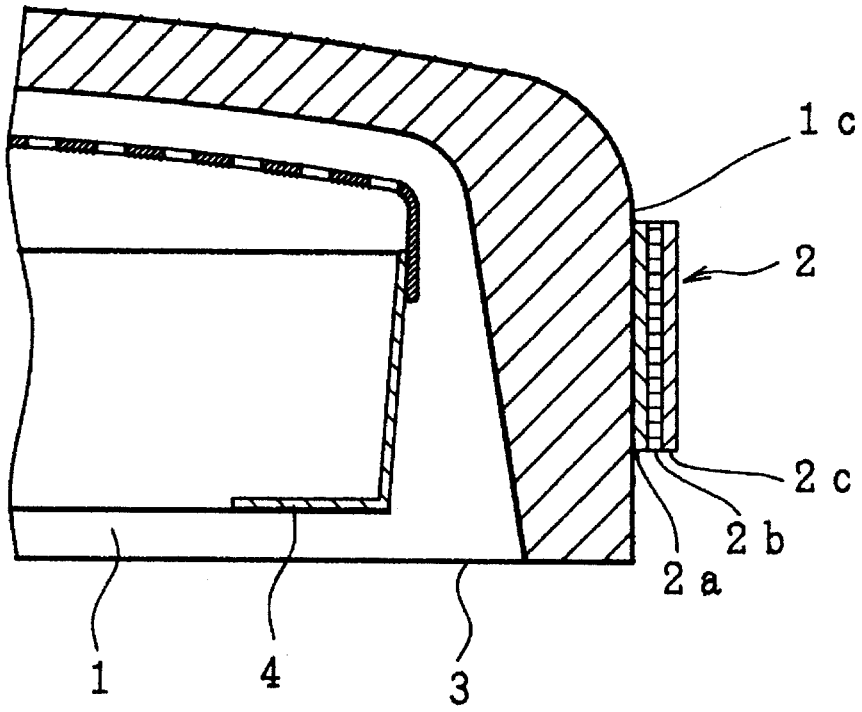
FIG. 2 is an enlarged sectional view of the glass panel equipped with the machine-readable marking.

FIG. 1 is a perspective view of a CRT embodying the present invention, the CRT being provided with an optically machine-readable coded marking attached to the external surface of the sidewall of the glass panel. FIG. 2 is an enlarged sectional view of the glass panel equipped with the optically machine-readable coded marking.

In FIGS. 1 and 2, numeral 1 denotes a glass panel, 1*a* the external surface of the glass panel, 1*b* the sidewall of the glass panel, 1*c* a panel mold match line, 2 an optically machine-readable coded marking, 2*a* an undercoating layer, 2*b* a mark portion, 2*c* an overcoating layer, 3 a sealing edge (sealing face), 4 a shadow mask, 5 a funnel, and 6 a neck.

A fluorescent screen is formed on the interior surface of the glass panel 1 and an area covered with the fluorescent screen forms an effective display area. The machine-readable marking 2 comprising the undercoating layer 2*a*, and the overcoating layer 2*c* is provided on the, sidewall 1*b* of the glass panel 1, whereas the shadow mask 4 is arranged inside the glass panel 1, the shadow mask 4 being opposite to the fluorescent screen. The glass panel 1 and the funnel 5 are connected by means of frit glass in the sealing face 3, and the neck 6 continuous to the funnel 5 has an electron gun inside. In this case, the machine-readable marking 2 contains a bar code only, or can include related numerals, characters, symbols and the like in addition to the bar code. Incidentally, an electron beam emitted from the electron gun is projected onto the fluorescent screen in the CRT thus constructed, whereby the fluorescent screen generates light so as to display a desired image on the effective display area. In other words, the CRT operates in the same manner as the prior art CRT does.

Figure 3:
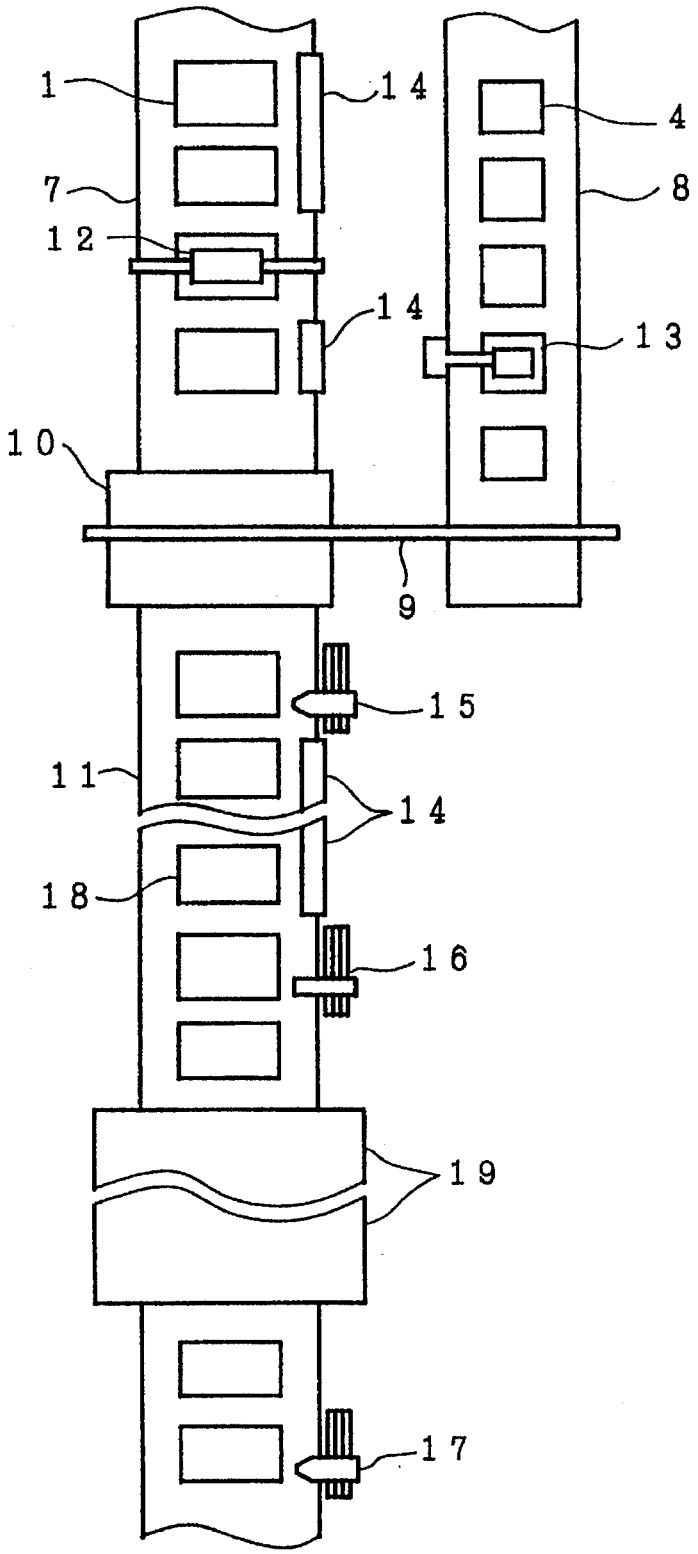
FIG. 3 is a block diagram illustrating the process of providing the machine-readable marking by means of a CRT manufacturing apparatus and the process prior to the above process.

FIG. 3 is a block diagram illustrating the process of providing the optically machine-readable coded marking 2 by means of a CRT manufacturing apparatus and the process prior to the process above.

In FIG. 3, numeral 7 denotes a glass panel conveyer, 8 a shadow mask conveyer, 9 a shadow mask transfer line, 10 a machine for assembling glass panels and shadow masks, 11 a panel mask assembly (PMA) conveyer, 12 a glass panel identifier, 13 a shadow mask identifier, 14 a heater, 15 an undercoating layer applicator, 16 an ink jet printer, 17 an overcoating layer applicator, and 18 a panel mask assembly (PMA). In addition, like reference characters designate like component parts of FIGS. 1 and 2. The panel mask assembly (PMA) 18 in this case means an assembly of a panel and a shadow mask.

The glass panel conveyer 7 and the shadow mask conveyer 8 are disposed substantially in parallel. At the ends of both the conveyers 7, 8 are the shadow mask transfer line 9 and the machine 10 for assembling glass panels and shadow masks. The glass panel identifier 12 and the shadow mask identifier 13 for determining the types, specifications, size and the like of the glass panel 1 and the shadow mask 4 thus conveyed are disposed close to the end of the glass panel conveyer 7 and that of the shadow mask conveyer 8, respectively. The heaters 14 are properly arranged along the glass panel conveyer 7. Moreover, the PMA conveyer 11 is continuously coupled to the glass panel conveyer 7 with the machine 10 for assembling glass panels and shadow masks as a starting point and the PMA 18 is conveyed thereon. The undercoating layer applicator 15, the ink jet printer 16, a heat treatment furnace 19 and the overcoating layer applicator 17 are disposed in the order named along the PMA conveyer 11, the heaters 14 being also properly arranged.

With the aforementioned components, the CRT manufacturing apparatus operates as follows:

Various types of glass panels 1 are conveyed in order from a panel storage (not shown) on the upstream side (the upper side of FIG. 3) of the glass panel conveyer 7 in accordance with a prearranged program. While the glass panel 1 thus conveyed is heated by the heaters 14, the size of the panel, transmittivity and reflectance on the effective surface area of the panel, the posture of the panel and the like are identified by the glass panel identifier 12. Moreover, shadow masks 4 corresponding in type to the glass panels 1 are conveyed in order from a mask storage (not shown) for storing assembled shadow masks 4 on the upstream side (the upper side of FIG. 3) of the shadow mask conveyer 8 in synchronization with the movement of the glass panels 1 in accordance with the aforementioned program. While the shadow mask 4 is thus conveyed, the type of the mask including the external shape of the mask, the size of the mask apertures, the spacing between the apertures, the configuration and direction of the mask and the like is identified by the shadow mask identifier 13.

When the glass panel 1 and the shadow mask 4 are identified to be mated with each other in the glass panel identifier 12 and the shadow mask identifier 13, the glass panel 1 and the shadow mask 4 conveyed via the shadow mask transfer line 9 are simultaneously supplied into the machine 10 for assembling glass panels and shadow masks, and the shadow mask 4 is automatically incorporated into the glass panel 1 to form a PMA 18. The PMA 18 is discharged from the machine 10 for assembling glass panels and shadow masks before being conveyed on the PMA conveyer 11.

The PMA 18 is initially conveyed to a prearranged position in the undercoating layer applicator 15 at this stage and white paint having heat- and acid-resistant properties, for instance, Kanpe Sera No. 155 (trade name) mainly composed of high polymeric polysiloxane resin of Kansai Paint Co., Ltd. (Japan) is applied by means of Select Coat (trade name) of Nordson Co. or an ordinary sprayer to form the undercoating layer 2*a*. While the PMA 18 is being conveyed, the undercoating layer 2*a* thus formed is dried by the heaters 14. The PMA 18 is subsequently conveyed to a prearranged position in the ink jet printer 16 and the mark 2*b* is printed on the undercoating layer 2*a* with light brown heat-resistant ink in good contrast with the color of the undercoating layer 2*a*, for instance, ink Jet printing ink "JP-T24" (trade name) of Hitachi, Ltd. by means of an ink Jet printer "FX series" (trade name) of Hitachi, Ltd. Then the PMA 18 with the undercoating layer 2*a* and the mark 2*b* formed thereon is passed through the heat treatment furnace 19 before being conveyed to a prearranged position in the overcoating layer applicator 17. In the overcoating layer applicator 17, transparent heat- and acid-resistant paint, for instance, Kanpe Sara ZC 120 (trade name), mainly composed of high polymeric polysiloxane resin of Kansai Paint Co., Ltd. is applied onto the mark 2*b* by means of the same applicator used in the case of the aforementioned undercoating layer 2*a*, whereby the formation of the optically machine-readable coded marking 2 to be attached to the sidewall 1*b* of the glass panel 1 is completed. In this case, the reason for the glass panel 1 to be passed through the heat treatment furnace 19 at the aforementioned process step is to prevent the ink of the mark 2*b* from running on when the overcoating is applied.

Further, means (not shown) for forming the fluorescent screen is arranged on the PMA conveyer 11 on the downstream side of the step at which the machine-readable marking 2 is formed.

Figure 4:
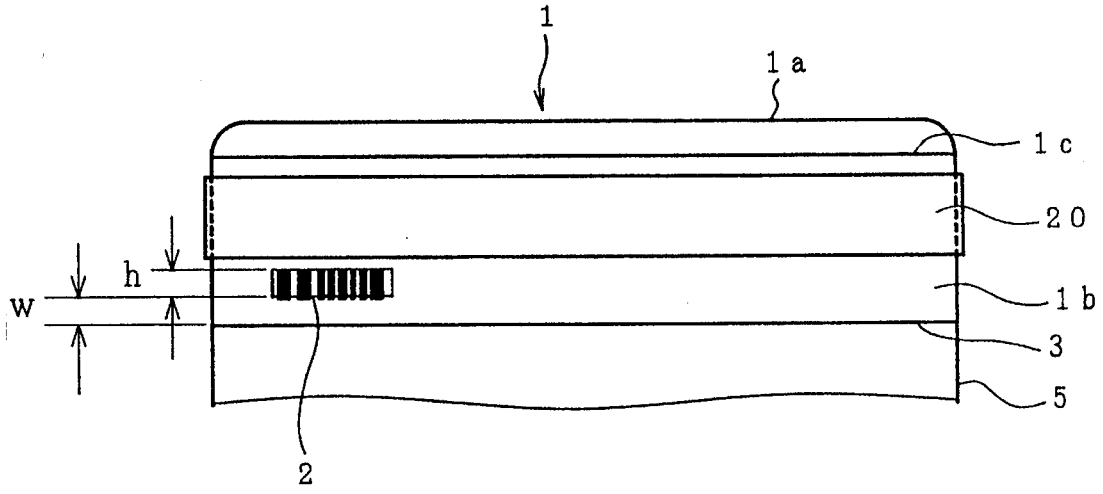
FIG. 4 is a block diagram illustrating a specific position for the machine-readable marking to be formed on the sidewall of the glass panel.

FIG. 4 illustrates a specific position of the machine-readable coded marking 2 to be formed on the sidewall 1*b* of the glass panel 1.

In FIG. 4, numeral 20 denotes an implosion proofing band for the glass panel 1, whereas like reference characters designate like component parts of FIGS. 1 to 2.

The machine-readable marking 2 to be printed has a bar code which is 15 mm or greater in height h with a thick bar whose width ranges from 0.5 to 2.0 mm. The reason for these dimensions is that these values are considered suitable from the standpoint of bar thickness (fineness) printable by the ink jet printer 16 and necessary for the quantity of information to be printed and read. Moreover, the position where the machine-readable marking 2 (bar code) is provided should be such that its lower limit line w is 5 mm or more away from the sealing edge (sealing face) of the glass panel 1, preferably about 10 mm away therefrom and that the machine-readable marking 2 (bar code) is not covered with the implosion proofing band 20 when this band is fitted thereto. With the machine-readable marking 2 (bar code) thus arranged, it is readily machine-readable after a CRT is actually incorporated in any product.

In such a case that the implosion proofing band 20 is designed to cover the whole side area 1*b* of the glass panel 1, depending on the type of CRT, the position of the machine-readable marking 2 (bar code) should be selected for such a type freely within a range not exceeding the mold match line 1*c*.

In addition, the glass panel identifier 12 and the shadow mask identifier 13 are provided with memory means which are not shown in FIG. 3. These memory means store types of machine-readable coded marking 2 to be formed on the glass panel 1, the contents identified by both the identifiers 12, 13, the time at which the machine-readable marking 2 is formed during the course of forming such a marking 2, the serial number of the manufacturing apparatus used to form the machine-readable marking 2 and the like. The memory means further supplies various pieces of information corresponding to the contents of the marking formed on the CRT conveyed on the conveyer, including processing and inspecting conditions characteristic of the CRT being processed to a mark reader at each post of the CRT conveyer that follows the means of forming the fluorescent screen in the CRT manufacturing apparatus. The memory means also stores the contents of the inspection made by the mark reader on the CRT and the time at which the CRT has arrived at the post concerned. With the provision of the memory means, it is possible to automatically effect various processes and inspections necessary for CRTs to be manufactured. Moreover, the data thus stored is utilizable for tracing the history of any CRT as a finished product.

As set forth above, the optically machine-readable coded marking 2 is formed on the sidewall 1*b* of the glass panel 1 through the steps of initially forming the undercoating layer 2*a* by applying the heat- and acid-resistant white paint, printing the mark 2*b* with the heat-resistant ink by means of the ink jet printer, and forming the overcoating layer 2*c* by applying the transparent heat- and acid-resistant paint in this embodiment. The machine-readable marking 2 is prevented from deteriorating even after the CRT undergoes every manufacturing process following that of forming the machine-readable marking 2. In other words, the machine-readable marking 2 is left unchanged in comparison with its initial state in which it has been formed.

The heat- and acid-resistant paint for use in forming the undercoating layer 2*a* and the overcoating layer 2*c* has been referred to as what is considered fit for use by way of example in the embodiment shown. The paint for use in forming the undercoating layer 2*a* and the overcoating layer 2*c* in the present invention is not limited to what has been stated above. Moreover, the paint sprayer referred to in this embodiment solely presents an example and it is needless to say that those other than what has been shown above can be employed. In addition, the ink or ink jet printer for forming the mark 2*b* as referred to in the embodiment also provides an example and those other than what has been shown above can be employed. Further, any ink color can be selected when the undercoating layer 2*a* and the mark 2*b* are formed as long as the former is white or similar light color and the latter in good contrast with the color of the undercoating layer 2*a*.

Another embodiment, with the omission of the overcoating layer applicator 17 can also attain the same effect as that of the embodiment shown above. Although the degree of deteriorating of machine-readable marking 2 becomes greater than that in the preceding embodiment, the deteriorating degree thereof considerably, decreases, in comparison with a case where the undercoating layer is not used, to the extent that no problem practically arises therefrom.

As set forth above, the optically machine-readable coded marking 2 formed on the sidewall 1*b* of the glass panel 1 during the course of manufacturing the CRT comprises the undercoating layer 2*a* of the heat- and acid-resistant paint, the mark 2*b* printed with the heat-resistant ink and the overcoating layer 2*c* of the transparent heat- and acid-resistant paint, or otherwise comprises the undercoating layer 2*a* and the mark 2*b*. Therefore, the marking is prevented from deteriorating or wearing away during the subsequent process of manufacturing the CRT with the effect of eliminating failure to read the marking during the subsequent process thereof and misreading of the marking.

According to the present invention, moreover, undercoating and overcoating layer applicators of ordinary construction may be usable even though those applicators 15, 17 or only the undercoating layer applicator 15 is required to be added during the process of manufacturing CRTs. As a result, the apparatus for manufacturing CRTs is prevented from becoming not only complicated in construction but also costly, in other words, the unit price of a CRT is not increased.

What is claimed is:

1. A cathode ray tube having a glass panel and an optically machine-readable marking on a sidewall of said glass panel, said machine-readable marking comprising an undercoating layer of heat-resistant and acid-resistant paint, a mark printed on said undercoating layer with heat-resistant ink, and a transparent heat-resistant and acid-resistant overcoating layer covering said mark.

2. A cathode ray tube as claimed in claim 1, wherein said undercoating layer is white or other light color.

3. A cathode ray tube as claimed in claim 1, wherein said mark is a bar code.

4. A cathode ray tube as claimed in claim 1, wherein said mark includes at least a bar code, and the width of a thick bar of said bar code ranges from 0.5 to 2.0 mm.

5. A cathode ray tube as claimed in claim 1, wherein said mark comprises a bar code and visually readable characters or symbols.

6. A cathode ray tube as claimed in one of claims 2 to 5, wherein an implosion-proofing band is disposed on said glass panel and a position of said bar code on a sidewall of said glass panel is not less than 5.0 mm away from a sealing edge of said glass panel and closer to said sealing edge than to a position of said implosion-proofing band.

7. A cathode ray tube as claimed in claim 1, wherein said undercoating and overcoating layers are mainly composed of high polymeric polysiloxane resin.

8. A cathode ray tube as claimed in claim 1, wherein said undercoating and overcoating layers comprise high polymeric polysiloxane resin.

* * * * *